United States Patent [19]

Boulton et al.

[11] 4,252,628

[45] Feb. 24, 1981

[54] MEMBRANE CELL

[75] Inventors: Thomas W. Boulton; Brian J. Darwent, both of Runcorn, England

[73] Assignee: Imperial Chemical Industries Limited, London, England

[21] Appl. No.: 880,493

[22] Filed: Feb. 23, 1978

[30] Foreign Application Priority Data

Mar. 4, 1977 [GB] United Kingdom ..... 919077/77

[51] Int. Cl.[2] ..... C25B 9/00; C25B 11/03; C25B 11/10; C25B 13/08

[52] U.S. Cl. ..... 204/257; 204/258; 204/279; 204/284; 204/290 F; 204/296

[58] Field of Search ..... 204/258, 266, 270, 279, 204/284, 96, 257, 128, 263–265, 255–256, 296

[56] References Cited

U.S. PATENT DOCUMENTS

| | | | |
|---|---|---|---|
| 2,682,505 | 6/1954 | Greco | 204/284 |
| 3,864,236 | 2/1975 | Lindstrom | 204/265 |
| 3,941,675 | 3/1976 | Strasser et al. | 204/290 F X |
| 4,069,129 | 1/1978 | Sato et al. | 204/266 X |
| 4,076,609 | 2/1978 | Mas | 204/255 X |
| 4,124,478 | 11/1978 | Tsien et al. | 204/279 X |
| 4,131,532 | 12/1978 | Chillier-Duchatel et al. | 204/258 X |

FOREIGN PATENT DOCUMENTS

| | | | |
|---|---|---|---|
| 494343 | 3/1976 | U.S.S.R. | 204/258 |

*Primary Examiner*—John H. Mack
*Assistant Examiner*—D. R. Valentine
*Attorney, Agent, or Firm*—Cushman, Darby & Cushman

[57] ABSTRACT

A monopolar filter press electrolytic cell suitable for use in the electrolysis of an aqueous alkali metal halide brine to produce (cell liquor, halogen and hydrogen, the cell comprising a plurality of flexible anode plates and flexible cathode plates and a cation perm-selective membrane positioned between each adjacent anode plate and cathode plate, and comprising a non-conducting flexible spacing plate positioned between each anode plate and adjacent membrane and between each cathode plate and adjacent membrane, the anode plates, cathode plates and spacing plates each having openings which define four separate compartments lengthwise of the cell and which provide respectively an inlet for brine, an inlet for water or alkaline water, an outlet for brine and halogen and an outlet for cell liquor and hydrogen the spacing plates being provided with passages which connect the compartments providing an inlet for brine and an outlet for brine and halogen with the anolyte compartments and which connect the compartments providing an inlet for water or alkali water and an outlet for cell liquor and hydrogen with the cathode compartments, the anode plates and cathode plates being made in part of a non-conducting material so that the compartments are electrically insulated from one another.

32 Claims, 4 Drawing Figures

MEMBRANE CELL

This invention relates to an electrolytic membrane cell, particularly to an electrolytic membrane cell of the filter press type.

A wide variety of membrane cells are known which consists in principle of a plurality of anodes and a plurality of cathodes disposed in a parallel alternating manner and separated from each other by substantially vertical cation-active permselective membranes. The anodes are suitably in the form of plates of a filmforming metal (usually titanium) and carry an electrocatalytically-active coating (for example a platinum group metal oxide); the cathodes are suitably in the form of a perforated plate or gauze of metal (usually mild steel); and the membranes, which are suitably in the form of sheets, may be of a synthetic organic material, for example a fluoropolymeric material, which contains cation exchange groups, for example sulphonate or carboxylate groups.

Monopolar electrolytic cells of the tank-type design, for example diaphragm cells of the tank-type design, generally contain diaphragms deposited on the cathodes, of the cell. Such cells are not suitable for use with sheet membranes because of the problems involved in cladding the sheets onto the complex cathode shapes which are used. Accordingly, filter press or "sandwich" type cell designs have been developed to accommodate membrane sheets. However such monopolar filter press cells are invariably more expensive than monopolar tank-type cells in respect of capital costs because of the relative complexity of their construction and because of the need to build in current distributors to reduce voltage drop in the anode-cathode module sizes conventionally considered.

We have now devised a monopolar filter press cell which is suitably for use with sheet membranes and which is readily made, is expensive, and is easily assembled.

According to the present invention there is provided a monopolar filter press electrolytic cell suitable for use in the electrolysis of an aqueous alkali metal halide solution (hereinafter referred to as brine) to produce an aqueous alkali metal hydroxide solution (hereinafter referred to as cell liquor), halogen and hydrogen which cell comprises a plurality of vertically disposed flexible anode plates and flexible cathode plates and a cation permselective membrane positioned between each adjacent anode plate and cathode plate, in which each anode plate is made in part of a non-conducting material and comprises an anode portion formed of a film-forming metal having an electrocatalytically active coating on the surface thereof, each cathode plate is made in part of a non-conducting material and comprises a metallic cathode portion, and in which a non-conducting flexible spacing plate is positioned between each membrane and adjacent anode plate and between each membrane and adjacent cathode plate, the anode plates, cathode plates and spacing plates each having openings which in the cell define four separate compartments lengthwise of the cell and which provide respectively for inlet brine, an outlet for brine and halogen, an inlet for water or alkaline water, and an outlet for cell liquor and hydrogen, the spacing plates being provided with passages in the walls thereof which in the cell connect the compartments providing an inlet for brine and an outlet for brine and halogen with the anolyte compartments defined by the spaces between the membrane and adjacent anode plates and which connect the compartments providing an inlet for water or alkaline water and an outlet for cell liquor and hydrogen with the catholyte compartments defined by the spaces between the membranes and adjacent cathode plates, the cell being provided with end plates providing end walls for the compartments, and the non-conducting parts of the anode plates and cathode plates insulating electrically the compartments providing an inlet for brine an an outlet for brine and halogen from the compartments providing an inlet for water or alkaline water and an outlet for cell liquor and hydrogen.

The end plates of the cell preferably comprise a terminal anode plate and a terminal cathode plate which do not necessarily comprise in part a non-conducting material. Thus the terminal anode plate may be made of a film-forming metal which carries an electrocatalytically active coating on a part of its surface, and the terminal cathode plate may be metallic.

The film-forming metal comprising a part the anode plate is preferably one of the metals titanium, zirconium, niobium, tantalum or tungsten or an alloy consisting principally of one or more of these metals and having anodic polarisation properties which are comparable with those of the pure metal. It is preferred to use titanium alone, or an alloy based on titanium and having polarisation properties comparable with those of titanium, as the film-forming metal in the anode plate. Examples of such alloys are titaniumzirconium alloys containing up to 14% of zirconium, alloys of titanium with up to 5% of a platinum group metal such as platinum, rhodium or iridium and alloys of titanium with niobium or tantalum containing up to 10% of the alloying constituent.

The cathode plate is suitably comprised in part of mild steel or iron, preferably of mild steel, but other metals may be used, for example nickel. The anode plates comprise an anode portion and parts having four openings therein which have dimensions corresponding to the cross-sections of the four compartments which in the cell are disposed lengthwise thereof. The openings may be defined by frame portions of the anode plates, and the openings in the plates are preferably diposed in pairs, one pair on each side of the anode portion the plates. In order that the compartments which in the cell provide an inlet for brine and an outlet for brine and halogen may be insulated electrically from the compartments which in the cell provide an inlet for water or alkaline water and an outlet for cell liquor and hydrogen the openings in the anode plate which in the cell provide a part of the compartment for the inlet brine and a part of the compartment for outlet brine and halogen may be defined by metal portions, for example, metal frame portions, e.g. of the same film-forming metal as that of the anode portion of the anode plate, in which case the openings in the anode plate which in the cell provide a part of the compartment for inlet water or alkaline water and a part of the compartment for outlet cell liquor and hydrogen should be defined by a non-conducting material, for example by frame portions of a non-conducting material, or vice versa. The part of the anode plate comprising the anode portion and the openings defined by a metallic part may conveniently be fabricated from a single sheet of fibre-forming metal. The parts of the anode plate made of a non-conducting material are fabricated separately and may be joined to the metallic part of the anode plate or may be assembled separately from the metallic part of the anode plate into the electrolytic cell.

The anode portion of the anode plate may be in the form of a perforated plate or gauze but is preferably in the form of louvres. The louvres are conveniently produced from a sheet of film-forming metal by pressing with a slittling and forming tool. The louvre slats so obtained may suitably be turned at right angles to the original plane of the film-forming metal sheet, or they may be inclined to this plane if desired. The louvred slats are preferably inclined at one angle of more than 60° to the plane of the anode sheet.

The louvres of each anode plate are preferably aligned so that their longitudinal axes are parallel to one another and, when the plates are installed in the cell, are vertically disposed. The electrocatalytically active coating on the anode portion of the anode plate is a conductive coating which is resistant to electrochemical attack but is active in transferring electrons between electrolyte and the anode.

The electrocatalytically active coating may suitably consist of one or more platinum group metals, i.e. platinum, rhodium, iridium, ruthenium, osmium and palladium, or alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phosphides and silicides of the platinum group metals. The coating may consist of one or more of the said platinum group metals and/or oxides thereof in admixture with one or mone non-noble metal oxides. Alternatively, it may consist of one or more non-noble metal oxides alone or a mixture of one or more non-noble metal oxides and non-nobel metal chloride discharge catalysts. Suitable non-noble metal oxides are, for example, oxides of the film-forming metals (titanium, zirconium, niobium, tantalum or tungsten), tin dioxide, germanium dioxide and oxides of antimony. Suitably chlorine-discharge catalysts include the difluorides of manganese, iron, cobalt, nickel and mixture thereof. Especially suitable electrocatalytically active coatings according to the invention include platinum itself and those based on ruthenium dioxide/titanium dioxide and ruthenium dioxide/tin dioxide/titanium dioxide.

Other suitable coatings include those described in our UK Patents Nos. 1402414 and 1484015 in which a non-conducting particulate or fibrous refractory material is embedded in a matrix of electrocatalytically active material (of the type described above). Suitable nonconducting particulate or fibrous materials include oxides, carbides, fluorides, nitrides and sulphides. Suitable oxides (including complex oxides) include zirconia, alumina, silica, thorium oxide, titanium dioxide, ceric oxide, hafnium oxide, ditantalum pentoxide, magnesium aluminate (e.g. spinel $MgO\ Al_2O_3$) aluminosilicates (e.g. mullite $(Al_2O_3)_3\ (SiO_2)_2$), zirconium silicate, glass, calcium silicate (e.g. bellite $(CaO)_2SiO_2$), calcium aluminate, calcium titanate (e.g. perovskite $CaTiO_3$), attapulgite, kaolinite, asbestos, mica, codierite and bentonite; suitable sulphides include dicerium trisulphide; suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

The anode plates may be prepared by a painting and firing technique, wherein a coating of metal and/or metal oxide is formed on the anode surface by applying to the surface of the anode plate a layer of a paint composition in a liquid vehicle comprising thermally-decomposable compounds of each of the metals that are to feature in the finished coating, drying the paint layer by evaporating the liquid vehicle, and then firing the paint layer by heating the coated anode plate, suitably at 250° C. to 800° C. to decompose the metal compounds of the paint and form the desired coating. When refractory particles or fibres are to be embedded in the metal and/or metal oxide of the coating, the refractory particles or fibres may be mixed into the aforesaid paint composition before it is applied to the anode. Alternatively, the refractory particles or fibres may be supplied on to a layer of the aforesaid paint composition while this is still in the fluid state on the surface of the anode, the paint layer then being dried by evaporation of the liquid vehicle and fired in the usual manner.

The anode coatings are preferably built up by applying a plurality of paint layers on the anode, each layer being dried and fired before applying the next layer.

The cathode portion of the cathode plate may comprise a perforated plate or gauze, but is preferably in the form of louvres. The louvres may be produced from a metal sheet, for example of mild steel or iron, by pressing with a slitting and forming tool as described above with reference to the anode plates. The cathode plates comprise a cathode portion and parts having four openings therein which have dimensions corresponding to the cross-sections of the four compartments which in the cell are disposed lengthwise of the cell. The openings may be defined by frame portions of the cathode plates, and the openings in the plates are preferably disposed in pairs, one pair one each side of the cathode portions of the plates. The cathode plates are constructed in part of metal, for example steel, e.g. mild steel, and in part of a non-conducting material and may have detailed construction similar to that hereinbefore described with reference to the anode plates so that in the cell the compartments which provide an inlet for brine and an outlet for brine and halogen are electrically insulated from the compartments which provide an inlet for water or alkaline water and an outlet for cell liquor and hydrogen.

The louvres of the cathode plates are preferably inclined at an angle of more than 60° to the plane of the cathode sheet.

The louvres of each cathode plate are preferably aligned so that their longitudinal axes are parallel to one another and when the plates are installed in a cell, are vertically disposed.

In the cell, successive anode plates and cathode plates are positioned so that the anode and cathode portions lie one behind another and the aforesaid openings are located one behind another to define the aforesaid compartments.

The spacing plates are preferably identical in shape and size with one another and each plate preferably has external dimensions which correspond to the dimensions of the anode plates and cathode plates. Each spacing plate is provided with a central opening corresponding in dimensions to the dimensions of the anode portion of the anode plate and the cathode portion of the cathode plate, and four openings which in the cell form a part of the compartments disposed lengthwise of the cell. The latter openings are preferably disposed in pairs, one pair on each side of the central opening in the spacing plate, and preferably formed by frame portions of the spacing plate.

The passage in the wall of the spacing plates are conveniently provided by slots in the walls so that in the cell the anolyte compartments are connected to the brine inlet compartment and the brine and halogen outlet compartment and the catholyte compartments are connected to the water or alkaline water inlet compartment and the cell liquor and hydrogen outlet compartment. The slots may carry flexible corrugated strips which thus provide a plurality of passages. Each spacing frame will thus have two passages in the walls of the plate.

The spacing plates may be fabricated in any suitable non-conducting material, but it is preferred to use a synthetic organic polymer which is inert to the conditions prevailing in the cell. Especially suitable polymers include polyvinylidene fluoride and polypropylene. The spacing plates are conveniently cut from a sheet of the polymer or moulded from the polymer.

The cell may conveniently be provided with sealing joints or gaskets which are suitably of an elastomeric material, for example of natural or synthetic rubber. The sealing joints or gaskets are suitably cut from a sheet of the elastomeric material or moulded from the elastomeric material, and correspond in overall size and shape to the aforesaid spacing plates.

In an alternative and preferred embodiment of the invention the spacing plates may be modified in shape and thickness to act as both spacers and as sealing joints or gaskets. In this case, the combined spacing plates and gaskets (referred to hereinafter as spacing gaskets) are conveniently made of an elastomeric material, for example natural or synthetic rubber, and passages in the walls of the spacing gaskets are provided for by incorporating a spring device which is either a pressing made of the anode or cathode material, or a flexible moulding in a suitable polymer. The spring device occupies a gap in the spacing gasket (such gaps occurring wherever gas or liquor must pass between adjacent compartments), and is designed to allow the flow of gas or liquor with the minimum of obstruction and to have a resiliency and depth compatible with the elastomer so that jointing pressure is transmitted.

The sealing joints or gaskets (or combined spacing frames and gaskets) are sufficiently thin and flexible to promote good jointing conditions in the cell in combination with the flexible anode plates, cathode plates and spacing frames (if present).

Any suitable cation exchange membrane material may be used as the membrane. Such materials are generally made of synthetic organic polymeric material which contains cation exchange groups, for example sulphonate or carboxylate groups. In particular, synthetic fluoropolymers which will withstand cell conditions for long periods of time are useful, for example the perfluorosulphonic acid membrane manufactured and sold by E I Du Pont de Nemours and Company under the trade mark 'NAFION' and which are based upon a hydrolysed copolymer of tetrafluoroethylene and a fluorosulphonated perfluorovinyl ether. Such membranes are described, for example in U.S. Pat. Nos. 2,636,851; 3,017,338; 3,496,077; 3,560,568; 2,967,807; 3,282,875 and UK Pat No. 1,184,321.

The anode plates, cathode plates and spacing plates may readily be made of a uniform thickness and may be made sufficiently thin for the plates to be flexible. This flexibility enables a uniform and adequate pressure to be maintained in cell jointing areas in the cell, thereby preventing leakage.

In one arrangement of the cell, single anode plates alternate with single cathode plates, with membranes interposed between adjacent anode and cathode plates. In an alternative arrangement, pairs of anode plates alternate with pairs of cathode plates, with membranes interposed between adjacent pairs of anode plates and pairs of cathode plates. The use of pairs of anode and cathode plates instead of single plates provides increased gas disengagement space in the vicinity of the anodes and cathodes.

The anode portion of each anode plate and the cathode portion of each cathode plate preferably has a dimension in the direction of current flow which is in the range 15 to 60 cm, particularly in the range 15 to 25 cm when using alternating single anode and cathode plates, and in the range 30 to 50 cm when using alternating pairs of anode and cathode plates. The aforesaid preferred dimensions of the anode and cathode plates provide short current paths which in turn ensure low voltage drops in the anode and cathode plates without the use of elaborate current carrying devices.

The distance between successive membranes in the cell is preferably in the range 5 to 20 mm, for example in the range 5 to 8 mm when using alternating single anode and cathode plates, and in the range 10 to 20 mm when using alternating pairs of anode and cathode plates.

In operation of the cell, brine, e.g. sodium chloride brine passes from a compartment lengthwise of the cell through passages in the walls of the spacing plates into the anolyte compartments of the cell. Chlorine gas produced in the anolyte compartments and brine, pass through other passages in the walls of the spacing plates into another compartment lengthwise of the cell.

The inlet water or alkaline water passes from a compartment through passages in the walls of the spacing plates into the catholyte compartments and cell liquor and hydrogen produced in the catholyte compartments pass through other passages in the walls of the spacing plates into another compartment lengthwise of the cell. Separation of chlorine and hydrogen gases from the corresponding liquors conveniently takes place outside the cell, for example in headers designed for the purpose.

The cell according to the present invention is therefore built up of formed or pressed anode and cathode plates of similar shape, separated by shaped moulded or cut-out spacing plates of a suitable non-conducting material, optionally together with the sealing joints or gaskets.

The cell is conveniently provided with end plates, adjacent respectivly to the terminal anode and cathode plates. The end plates are suitably of mild steel, suitably protected from the cell environment e.g. by means of a plastics spacer and the whole assembly may be clamped together, for example by bolting the end plates. This simple design advantageously allows a commercial cell to be constructed at a relatively low capital cost as compared with conventional monopolar tank-type cells or bipolar filter press cells.

The use of thin flexible anode plates and cathode plates makes it unnecessary for the plates to be made perfectly plane during manufacture since the plates become flattened whilst assembling because of the pressure exerted by the end plates which may be of comparatively massive construction. Moreover, the use of thin anode and cathode plates (e.g. 1 mm thickness) results in the louvres formed in the active portions of the anode and the cathode having little strength so that they are easily deflected by the membrane, if they come into contact with it and during assembling, thereby avoiding damage to the membrane. In this way, a relatively small anode/cathode gap, for example 2 mm, can simply and effectively be achieved.

The overall length of the cell will inevitably be greater than the thickness of the individual modules. It is envisaged, for example, that current connection to the modules of a cell will be by means of a plurality of flexible current connectors equal in number to the number of cell modules in the cell.

A plant for the production of halogen and alkali metal hydroxide solution may comprise a plurality of cells of the present invention may be connected to one another by means of tie rods or clamps passing through or around the assembly of flexible connectors and the anode and cathode plates as appropriate. Where such a plurality of cells are used and a particular cell has to be taken out of operation, that is electrically isolated, a jumper switch may be positioned directly above the cell to be removed from operation and connections may be made to appropriate points along the whole length of the inter cell connectors by means of a similar tie rod or clamp arrangement. The cell may then be removed either from beneath or from the side. Alternatively, the jumper switch may be placed beneath the cell and the cell removed from above.

The invention is especially applicable to membrane cells used for the manufacture of chlorine and sodium hydroxide by electrolysis of aqueous sodium chloride solutions.

By way of example, an embodiment of the invention will not be described with reference to the accompanying drawings in which FIG. 1 is a perspective expanded view of part of a membrane cell according to the invention, and FIG. 2 is a diagrammatic end view of the part of the cell of FIG. 1 viewed in the direction A; FIG. 2 is cut away to display successive components of the cell.

Figure 1:
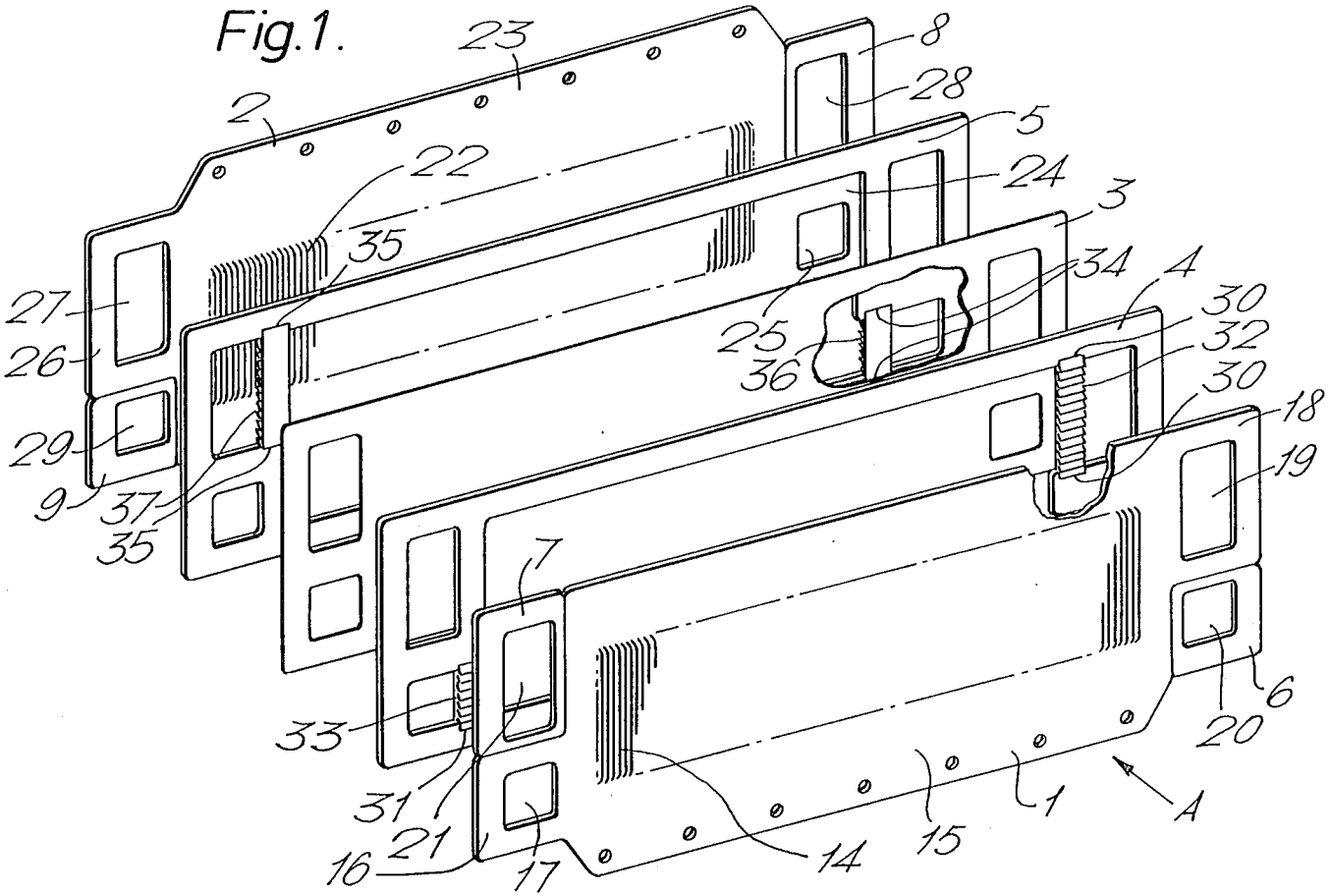
Figure 2:
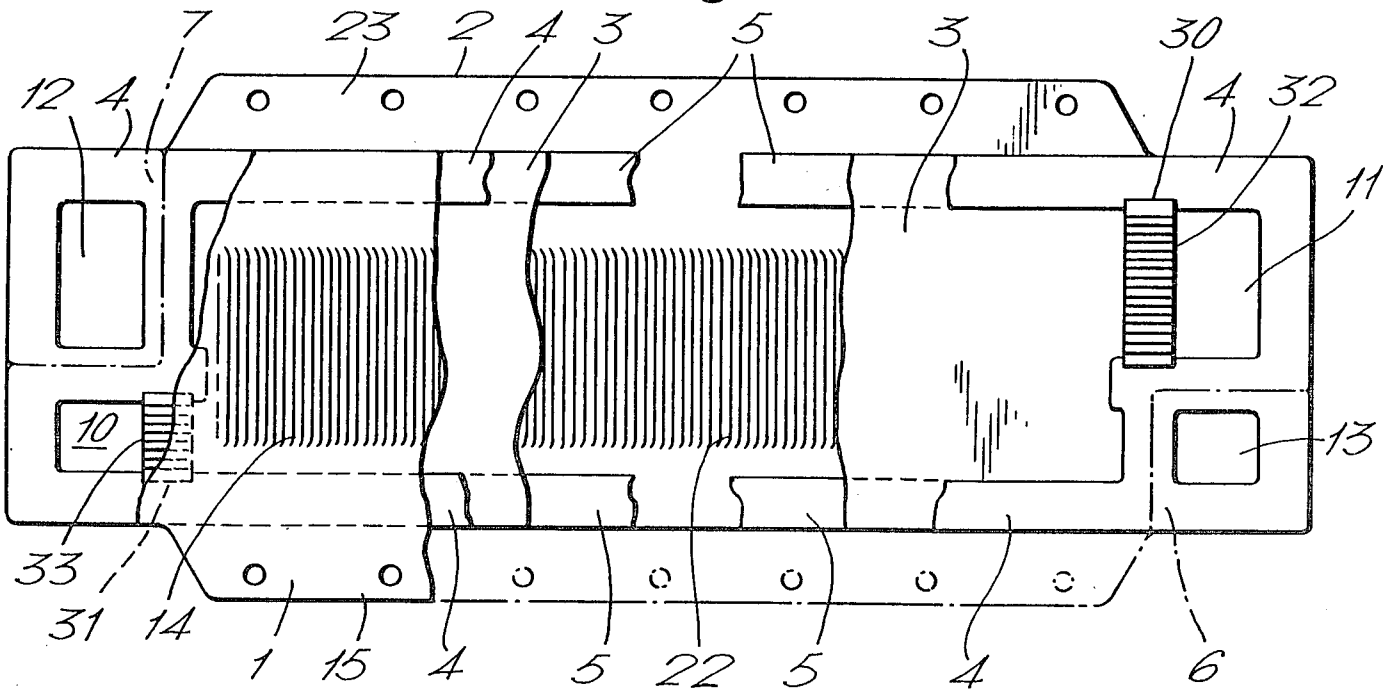

Referring to FIGS. 1 and 2, the part of the cell illustrated comprises an anode plate 1, a cathode plate 2, a membrane 3, and spacing gaskets 4 and 5. The cell further comprises end plates (not shown), suitably of mild steel, and gaskets (not shown), suitably of an elastomeric material, e.g. rubber, which are inserted between each end plate and adjacent end anode plate and end cathode plate.

The membrane 3 separates an anolyte module comprising the anode plate 1, and spacing gasket 4 from a catholyte module comprising the cathode plate 2, and spacing gasket 5. The cell shown in FIG. 1 contains an anolyte module and a catholyte module, but it will be appreciated that a commercial cell could contain a plurality of such modules, typically 200 to 500 modules.

The whole assembly of modules may be clamped together (with provision for heat expansion) by means of bolts and springs, or hydraulic devices to form the filter press electrolytic membrane cell.

The individual components of the cell referred to above (and discussed in detail below) combine in the cell (as shown in FIG. 2) to define compartments 10, 11, 12 and 13 which provide respectively an inlet for feed brine, an outlet for spent brine and halogen, an outlet for cell liquor and hydrogen, and an inlet for water or alkaline water. The dimensions of the anolyte (or catholyte) compartments are determined by the distance between the membrane 3 and the anode plate 1 (or cathode plate 2) and by the cross-sections of the active anode (or cathode) of the anode (or cathode) plate areas as discussed below.

The anode plate 1 is fabricated in part of a film-forming metal, preferably titanium. It is provided with an active anode area in the form of a plurality of louvres 14 carrying an electrocatalytically active coating, for example, a mixture of ruthenium oxide and titanium dioxide. The anode plate 1 has an extended portion 15 for connecting to a source (not shown) of electric current. The anode plate 1 has a lower frame portion 16, defining an opening 17 the dimensions of which corespond to the cross-section of the compartment 10 for inlet feed brine, and an upper frame portion 18 defining an opening 19 the dimensions of which correspond to the cross-section of the compartment 11 for spent brine and halogen. The anode plate 1 also has a frame portion 6 of a non-conducting material which defines an opening 20 the dimensions of which correspond to the cross-section of the compartment 13 for inlet water or alkaline water, and a frame portion 7 of a non-conducting material which defines an opening 21 the dimensions of which correspond to the cross-section of the compartment 12 for cell liquor and hydrogen. The frame portions 6 and 7 are conveniently fabricated of a plastics material, for example polypropylene.

The cathode plate 2 is suitably fabricated in part of mild steel or iron, and preferably of mild steel. It is provided with an active cathode area in the form of a plurality of louvres 22, and an extended portion 23 for leading away the electric current. The cathode plate 2 has a lower frame portion 24, defining an opening 25 the dimensions of which correspond to the cross-section of the compartment 13 for inlet water or alkaline water, and an upper frame portion 26 defining an opening 27 the dimensions of which correspond to the cross-section of the compartment 12 for cell liquor and hydrogen.

The cathode plate 2 also has a frame portion 8 of a non-conducting material which defines an opening 28 the dimensions of which correspond to the cross-section of the compartment 11 for spent brine and halogen, and a frame portion 9 which defines an opening 29 the dimensions of which correspond to the cross-section of the compartment 10 for inlet brine. The frame portions 8 and 9 are conveniently fabricated of a plastics material, for example polypropylene.

The spacing gaskets 4, 5 are fabricated of an elastomeric material, for example natural or synthetic rubber. Each spacing gasket 4, 5 is provided with five openings, the dimensions of which are respectively substantially the same as the dimensions of the louvred areas of the anode and cathode plates and the dimensions of the openings in the anode and cathode plates which define the compartments 10, 11, 12 and 13.

Spacing gasket 4 is provided with slots 30 and 31 in the face of the plate which accommodate flexible corrugated strips 32 and 33 respectively. The strips 32 and 33 are suitably of a film-forming metal, for example titanium, or a polymer, for example polyvinylidene fluoride. The strips 32 and 33 define passages between the anolyte compartment and the compartments 11 and 10 respectively.

Spacing gasket 5 is provided with slots 34 and 35 which accommodate flexible corrugated strips 36 and 37 respectively. The strips 36 and 37, are suitably of mild steel or a polymer, for example polyvinylidene fluoride. The strips 36 and 37, define passages between the catholyte compartment and the compartments 13 and 12 respectively.

The gaskets (not shown) which are adjacent to the end plates may be fabricated from an elastomeric material, for example natural or synthetic rubber, and may be identical in external dimensions with the spacing gaskets 4 and 5 except that the gaskets are not provided with passages.

The cell is suitably provided with inlet conduits (not shown) for brine (connected to compartment 10) and for water or alkaline water (connected to compartment 13), and outlet conduits (not shown) for spent brine and halogen (connected to compartment 11) and for the cell liquor and hydrogen (connected to compartment 12).

In operation, brine passes from the compartment 10 through the passages defined by corrugated strip 33 in spacing gasket 4 into the anolyte compartment, and spent brine and halogen passes through the passages defined by corrugated strips 32 in spacing gasket 4 into the compartment 11. Inlet water or alkaline water passes fro the compartment 13 through the passages defined by corrugated strip 36 in spacing gasket 5 into the catholyte compartment, and cell liquor and hydrogen passes through the passages defined by corrugated strip 37 in spacing gasket 5 into the compartment 12. The compartments 11 and 12 are connected to headers (not shown) from which halogen and hydrogen disengage.

Figure 3:
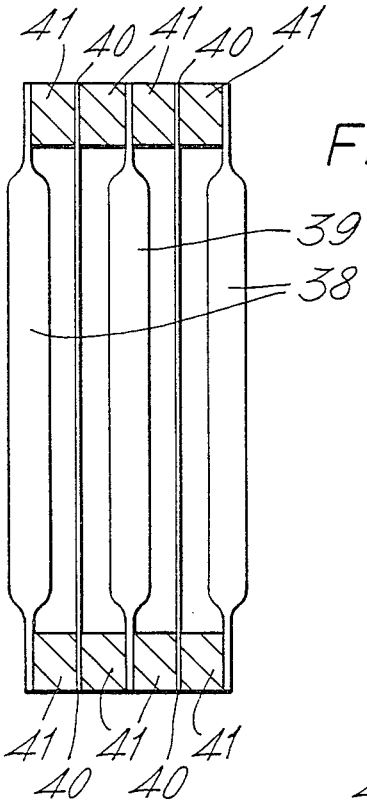
FIG. 3 is a diagrammatic sketch of a cell according to the invention comprising single anode plates alternating with single cathode plates.

The cell of the type shown in FIGS. 1 and 2 is shown diagrammatically in FIG. 3 to illustrate an arrangement of single anode plates 38 (corresponding to anode plates 1 in FIGS. 1 and 2) alternating with single cathode plates 39 (corresponding to cathode plates 2 in FIGS. 1 and 2), with membranes 40 positioned between the anode plates 38 and cathode plates 39. FIG. 3 also shows the gaskets 41 (corresponding to spacing plates 4, 5 in FIG. 1 or 2).

Figure 4:
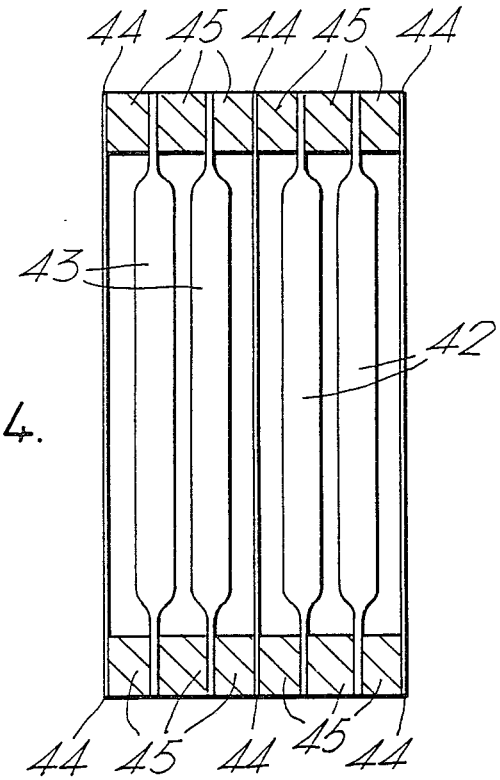
FIG. 4 is a diagrammatic sketch of a cell according to the invention comprising pairs of anode plates alternating with pairs of cathode plates.

Referring to FIG. 4, a cell is shown diagrammatically to illustrate an alternative arrangement of alternating pairs of anode plates 42 and pairs of cathode plates 43, in combination with membranes 44 and gaskets 45.

Use of the cell according to the invention is illustrated by the following Example:

EXAMPLE

A membrane cell according to the invention was provided with one titanium louvred anode plate 1 (each 0.75 mm thickness) coated with a mixture of ruthenium oxide and titanium dioxide, one mild steel louvred cathode plate 2 (each 0.75 mm thickness), and one 'NAFION' membrane (a perfluorosulphonic acid membrane manufactured and sold by Du Pont under the trade name 'NAFION', of 0.3 mm thickness). The length of the louvres 14, 22 of the anode and cathode plates which follow the direction of current flow was 15 cm. The anode/cathode gap (between the extremity of the louvred surfaces) was 2 mm. The distance between membrane surfaces in a cell of this type containing more than one membrane would be 6 mm. The spacing gaskets 4, 5 were fabricated in synthetic rubber.

The cell was fed with sodium chloride brine (300 g/liter NaCl) at a rate of 5 liters/hour, and a current of 500 amps (corresponding to a current density of 3.5 $kA/m^2$) was passed through the cell. The cell operating voltage was 4.0 volts. The chlorine produced contained 91–93% by weight of $Cl_2$ and 6–8% by weight of $O_2$. The sodium hydroxide produced contained 20% by weight of NaOH. The cell operated at a current efficiency of 83%.

What we claim is:

1. A monopolar filter press electrolytic cell suitable for use in the electrolysis of an aqueous alkali metal halide solution (brine) to produce an aqueous alkali metal hydroxide solution (cell liquor), halogen and hydrogen which cell comprises a plurality of vertically disposed flexible anode plates and flexible cathode plates and a cation permselective membrane positioned between each adjacent anode plate and cathode plate, characterised in that each anode plate is made in part of a non-conducting material and comprises an anode portion formed of a film-forming metal having an electrocatalytically active coating on the surface thereof, each cathode plate is made in part of a non-conducting material and comprises a metallic cathode portion, and in which a non-conducting flexible spacing plate is positioned between each membrane and adjacent anode plate and between each membrane and adjacent cathode plate, the anode plates, cathode plates and spacing plates each having openings which in the cell define four separate compartments lengthwise of the cell and which provide respectively for inlet brine, an outlet for brine and halogen, an inlet for water or alkaline water, and an outlet for cell liquor and hydrogen, the spacing plates being provided with passages in the walls thereof which in the cell connect the compartments providing an inlet for brine and an outlet for brine and halogen with the anolyte compartments defined by the spaces between the membranes and adjacent anode plates and which connect the compartments providing an inlet for water or alkaline water and an outlet for cell liquor and hydrogen with the catholyte compartments defined by the spaces between the membranes and adjacent cathode plates, the cell being provided with end plates which form end walls for the compartments, and the non-conducting parts of the anode plates and cathode plates insulating electrically the compartments providing an inlet for brine and an outlet for brine and halogen from the compartments providing an inlet for water or alkaline water and an outlet for cell liquor and hydrogen.

2. A cell as claimed in claim 1 characterised in that the end plates comprise a terminal anode plate and a terminal cathode plate.

3. A cell as claimed in claim 1 wherein each anode plate comprises an anode portion and parts having four openings therein which have dimensions corresponding to the cross-sections of the four compartments disposed lengthwise of the cell.

4. A cell as claimed in claim 1 wherein the openings are defined by frame portions of the anode plates, and the openings in the plates are disposed in pairs, one pair on each side of the anode portion of the plates.

5. A cell as claimed in claim 4 wherein the openings in the anode plate which in the cell provide a part of the compartment for the inlet brine and a part of the compartment for outlet brine and halogen are defined by metal frame portions of the same film-forming metal as that of the anode portion of the anode plate, and wherein the openings in the anode plate which in the cell provide a part of the compartment for inlet water or alkaline water and a part of the compartment for outlet cell liquor and hydrogen are defined by frame portions of a non-conducting material.

6. A cell as claimed in claim 5 wherein the anode portion and the openings defined by the metal frame portions are fabricated from a single sheet of film-forming metal.

7. A cell as claimed in claim 5 wherein the film-forming metal is titanium.

8. A cell as claimed in claim 1 wherein the electrocatalytically active coating comprises a mixture of a platinum group metal oxide and a film-forming metal oxide.

9. A cell as claimed in claim 8 wherein the coating comprises a mixture of ruthenium oxide and titanium dioxide.

10. A cell as claimed in claim 1 wherein each cathode plate comprises a cathode portion and parts having four openings therein which have dimensions corresponding to the cross-sections of the four compartments.

11. A cell as claimed in claim 10 wherein the openings in the cathode plate which in the cell provide a part of the compartment for the inlet water or alkaline water and a part of the compartment for outlet cell liquor and hydrogen are defined by metal frame portions of the same metal as that of the cathode portion of the cathode plate, and wherein the openings in the cathode plate which in the cell provide a part of the compartment for inlet brine and a part of the compartment for outlet brine and halogen are defined by frame portions of a non-conducting material.

12. A cell as claimed in claim 11 wherein the cathode portion and the openings defined by the metal frame portions are fabricated from a single sheet of metal.

13. A cell as claimed in claim 9 wherein the metal is mild steel.

14. A cell as claimed in claim 1 wherein each spacing plate is identical in shape and size with one another and has external dimensions which correspond to the dimensions of the anode plates and cathode plates.

15. A cell as claimed in claim 1 wherein each spacing plate is provided with a central opening corresponding in dimensions to the dimensions of the anode portion of the anode plate and the cathode portion of the cathode plate, and four openings which in the cell form a part of the compartments disposed lengthwise of the cell, said openings being defined by frame portions of the spacing plate and disposed in pairs, one pair on each side of the central opening in the spacing plate.

16. A cell as claimed in claim 15 wherein the passages in the wall of spacing plates are provided by slots in the walls so that the anolyte compartments are connected to the brine inlet compartment and the brine and halogen outlet compartment and the catholyte compartments are connected to the water or alkaline water inlet compartment and the cell liquor and hydrogen outlet compartment.

17. A cell as claimed in any one of claims 1–7, 8–13, 14, 15 or 16 wherein the spacing plate is fabricated of polyvinylidene fluoride or polypropylene.

18. A cell as claimed in claim 1 which further comprises sealing joints or gaskets of elastomeric material corresponding in overall size and shape to the spacing plates.

19. A cell as claimed in claim 1 wherein the membrane comprises a perfluoro-sulphonic acid based upon a hydrolysed copolymer of polytetrafluoroethylene and a fluorosulphonated perfluorovinyl ether.

20. A cell as claimed in claim 1 wherein single anodes alternate with single cathodes, with membranes interposed between successive anodes and cathodes.

21. A cell as claimed in claim 1 wherein pairs of anodes alternate with pairs of cathodes, with membranes interposed between successive pairs of anodes and cathodes.

22. A cell as claimed in claim 1 wherein each anode and each cathode has a dimension in the direction of current flow which is in the range 15 cm to 60 cm.

23. A cell as claimed in claim 20 or claim 22 in which each anode and each cathode has a dimension in the range 15 to 25 cm.

24. A cell as claimed in claim 21 or claim 22 in which each pair of anodes and each pair of cathodes has a dimension in the direction of current flow which is in the range 30 to 50 cm.

25. A cell as claimed in claim 1 wherein the distance between successive membranes is in the range 5 to 20 mm.

26. A cell as claimed in any one of claims 20, 22, or 25 wherein the distance between successive membranes is in the range 5 to 8 mm.

27. A cell as claimed in any one of claims 21, 22, or 25, wherein the distance between successive membranes is in the range 10 to 20 mm.

28. A monopolar filter press electrolytic cell suitable for use in the electrolysis of an aqueous alkali metal halide solution (brine) to produce an aqueous alkali metal hydroxide solution (cell liquor), halogen and hydrogen which cell comprises a plurality of vertically disposed flexible anode plates and flexible cathode plates and a cation permselective membrane positioned between each adjacent anode plate and cathode plate, characterized in that each anode plate is made in part of a non-conducting material and comprises an anode portion in the form of louvres, said anode portion being formed of a film-forming metal having an electrocatalytically active coating on the surface thereof, each cathode plate is made in part of a non-conducting material and comprises a metallic cathode portion, and in which a non-conducting flexible spacing plate is positioned between each membrane and adjacent anode plate and between each membrane and adjacent cathode plate, the anode plates, cathode plates and spacing plates each having openings which in the cell define four separate compartments lengthwise of the cell and which provide respectively for inlet brine, an outlet for brine and halogen, an inlet for water or alkaline water, and an outlet for cell liquor and hydrogen, the spacing plates being provided with passages in the walls thereof which in the cell connect the compartments providing an inlet for brine and an outlet for brine and halogen with the anolyte compartments defined by the spaces between the membranes and adjacent anode plates and which connect the compartments providing an inlet for water or alkaline water and an outlet for cell liquor and hydrogen with the catholyte compartments defined by the spaces between the membranes and adjacent cathode plates, the cell being provided with end plates which form end walls for the compartments, and the non-conducting parts of the anode plates and cathode plates insulating electrically the compartments providing an inlet for brine and an outlet for brine and halogen from the compartments providing an inlet for water or alkaline water and an outlet for cell liquor and hydrogen.

29. A cell as in claim 28 wherein the louvres are aligned so that their longitudinal axes are parallel to one another and vertically disposed.

30. A monopolar filter press electrolytic cell suitable for use in the electrolysis of an aqueous alkali metal halide solution (brine) to produce an aqueous alkali metal hydroxide solution (cell liquor), halogen and hydrogen which cell comprises a plurality of vertically disposed flexible anode plates and flexible cathode plates and a cation permselective membrane positioned between each adjacent anode plate and cathode plate, characterized in that each anode plate is made in part of a non-conducting material and comprises an anode portion formed of a film-forming metal having an electrocatalytically active coating on the surface thereof, each cathode plate is made in part of a non-conducting material and comprises a metallic cathode portion in the form of louvres, and in which a non-conducting flexible spacing plate is positioned between each membrane and adjacent anode plate and between each membrane and adjacent cathode plate, the anode plates, cathode plates and spacing plates each having openings which in the cell define four separate compartments lengthwise of the cell and which provide respectively for inlet brine, an outlet for brine and halogen, an inlet for water or alkaline water, and an outlet for cell liquor and hydrogen, the spacing plates being provided with passages in the walls thereof which in the cell connect the compartments providing an inlet for brine and an outlet for brine and halogen with the anolyte compartments defined by the spaces between the membranes and adjacent anode plates and which connect the compartments providing an inlet for water or alkaline water and an outlet for cell liquor and hydrogen with the catholyte compartments defined by the spaces between the membranes and adjacent cathode plates, the cell being provided with end plates which form end walls for the compartments, and the non-conducting parts of the anode plates and cathode plates insulating electrically the compartments providing an inlet for brine and an outlet for brine and halogen from the compartments providing an inlet for water or alkaline water and an outlet for cell liquor and hydrogen.

31. A cell as in claim 30 wherein the louvres are aligned so that their longitudinal axes are parallel to one another and are vertically disposed.

32. A monopolar filter press electrolytic cell suitable for use in the electrolysis of an aqueous alkali metal halide solution (brine) to produce an aqueous alkali metal hydroxide solution (cell liquor), halogen and hydrogen which cell comprises a plurality of vertically disposed flexible anode plates and flexible cathode plates and a cation permselective membrane positioned between each adjacent anode plate and cathode plate, characterized in that each anode plate is made in part of a non-conducting material and comprises an anode portion formed of a film-forming metal having an electrocatalytically active coating on the surface thereof, each cathode plate is made in part of a non-conducting material and comprises a metallic cathode portion, and in which a non-conducting flexible spacing plate is positioned between each membrane and adjacent anode plate and between each membrane and adjacent cathode plate, the anode plates, cathode plates and spacing plates each having openings which in the cell define four separate compartments lengthwise of the cell and which provide respectively for inlet brine, an outlet for brine and halogen, an inlet for water or alkaline water, and an outlet for cell liquor and hydrogen, the spacing plates being provided with passages in the walls thereof which in the cell connect the compartments providing an inlet for brine and an outlet for brine and halogen with the anolyte compartments defined by the spaces between the membranes and adjacent anode plates and which connect the compartments providing an inlet for water or alkaline water and an outlet for cell liquor and hydrogen with the catholyte compartments defined by the spaces between the membranes and adjacent cathode plates, each spacing plate being made of an elastomeric material and serving as a combined spacing plate and sealing joint or gasket, and wherein the passages of the plate are in the form of a spring device incorporated into the spacing plate and comprising a pressing made of the anode or cathode material or a flexible polymeric moulding, the cell being provided with end plates which form end walls for the compartments, and the non-conducting parts of the anode plates and cathode plates insulating electrically the compartments providing an inlet for brine and an outlet for brine and halogen from the compartments providing an inlet for water or alkaline water and an outlet for cell liquor and hydrogen.

* * * * *